United States Patent [19]

Morris et al.

[11] 4,434,516

[45] Mar. 6, 1984

[54] WALL SLEEVE AND INSTALLATION JIG FOR MULTIPLE ADJACENT FIXTURE MOUNTING

[75] Inventors: Earl L. Morris, La Habra Heights; V. Walter Hafner, Whittier, both of Calif.

[73] Assignee: Acorn Engineering Company, City of Industry, Calif.

[21] Appl. No.: 455,746

[22] Filed: Jan. 5, 1983

[51] Int. Cl.[3] ..... A47K 4/00; E03D 11/00

[52] U.S. Cl. ..... 4/252 R; 4/191; 49/55

[58] Field of Search ..... 4/191, DIG. 7, 192, 4/252 R, 663, 664; 49/55; 52/35, 106, 34

[56] References Cited

U.S. PATENT DOCUMENTS

| | | | |
|---|---|---|---|
| 3,129,437 | 4/1964 | McClenahan | 4/252 R |
| 3,435,467 | 4/1969 | Flegel et al. | 4/252 R |
| 3,495,283 | 2/1970 | Studer | 4/252 R |
| 3,701,172 | 10/1972 | McClenahan | 4/252 R |
| 3,932,899 | 1/1976 | Brady et al. | 4/252 R X |
| 3,942,201 | 3/1976 | Morris et al. | 4/252 R |
| 4,058,859 | 11/1977 | Arrowood | 4/252 R |

*Primary Examiner*—Henry K. Artis

*Attorney, Agent, or Firm*—Edgar W. Averill, Jr.

[57] ABSTRACT

A wall sleeve and installation jig for the vandal-resistant mounting of multiple adjacent fixtures. The jig is positioned in a wall such as the wall of a prison cell and fixtures such as a lavatory, mirror, light or the like are securely mounted thereon.

12 Claims, 4 Drawing Figures

WALL SLEEVE AND INSTALLATION JIG FOR MULTIPLE ADJACENT FIXTURE MOUNTING

CROSS REFERENCE TO RELATED APPLICATIONS

This application is being filed the same day as the following applications which are assigned to the assignee of the present application: Ser. No. 455,753, Vandal Resistant Push Button Electrical Switch Assembly; Ser. No. 455,752 Vandal Resistant and Tamper-Proof Plenum or Vacuum Chamber Security Air Flow Adjustment Device; Ser. No. 455,751, Plenum/Vacuum Chamber with Duct Connection for Installation in Cabinet Fixtures to Control Air Supply or Return; Ser. No. 455,750, Vandal Resistant Light Fixture; Ser. No. 455,668 Security Mirror Replaceable from Pipe Chase and Ser. No. 455,665, Vandal Resistant and Tamper-Proof Multi-Purpose Modular Lavatory/Toilet.

BACKGROUND OF THE INVENTION

The field of the invention is devices for facilitating the secure attachments of fixtures to a wall. The invention relates more particularly to the mounting of fixtures in prisons, mental institutions and other locations where it is essential that the fixtures be secured in such a manner that it is virtually impossible to remove them from the wall from the cell side. It is also important in such environments that the mounting device not provide any means of escape even in the event the fixture is temporarily removed.

An improved fixture housing device is disclosed in an application assigned to the assignee of the present application having the title "Combined Wall Construction Form and Plumbing Fixture Mounting Device for Fire-Rated Wall Construction" Ser. No. 421,078 filed Sept. 22, 1982. This device permitted the secure mounting of a fixture in a poured concrete or block wall. Like the device in the present invention, this fixture mounting device also was designed for installation in prison, mental institutions and other locations requiring exceptionally secure mounting. The advantage of mounting multiple fixtures immediately adjacent one another has been recently recognized and it is particularly desirable that a fixture containing a mirror and shelf be mounted directly above a lavatory fixture. Furthermore, the adjacent mounting of a light fixture above the mirror and shelf fixture is also highly desirable. In the past each fixture had its own mounting jig and the relatively large flange about the top and bottom edges of each installation jig prevented the fixtures from being adjacent. Individual mounting jigs are expensive to install as compared to a single jig. Attempts to mount two fixtures on one jig resulted in a crevice or crack which could be used to conceal a potential weapon such as a razor blade or contraband and thus was totally unacceptable in prison and mental institutions.

Other common methods of mounting plumbing fixtures involved cutting holes through concrete blocks or through a concrete wall and passing the pipes and attachment means through such holes and simply bolting the fixtures through holes cut in the wall. Such methods were of course very time consuming and expensive. A better method of mounting a single fixture is shown in U.S. Pat. No. 3,701,172 (McClenahan). However, when concrete was poured against the inner face of the plate disclosed in the McClenahan patent the pipes which were held to the plate were occasionally knocked out of line thereby providing an imperfect opening.

A further improvement in installation jigs is disclosed in U.S. Pat. No. 3,942,201 (Morris et al.). This sleeve, however, does not permit the mounting of multiple adjacent fixtures without the creation of the above-referred safety hazard.

SUMMARY OF THE INVENTION

It is an object of the present invention to provide a wall sleeve and installation jig for the mounting of multiple adjacent fixtures.

The present invention is for a wall sleeve and installation jig for multiple adjacent fixture mounting. Such a jig is particularly useful in the wall of a cell where the cell is on one side of the wall and a pipe chase (referred to herein as simply as chase) is on the other side of the wall. The chase permits access to the back of the fixtures of servicing without the necessity of entering the cell. The wall sleeve and installation jig of the present invention has a horizontal base member having one edge along the chase and its other edge along the cell wall. The base member has a flange positioned along the chase edge thereof. A first vertical side member is affixed at its bottom to one end of the base member and the side member has a chase edge and a cell edge and a web therebetween. A flange is positioned along the chase edge of the vertical side member. A second vertical side member is also affixed at its bottom to the other end of the base member. The second side member also has a chase edge and a cell edge and a web therebetween and the chase edge has a flange positioned therealong. A horizontal top member is affixed to the other upper end of the first and second side members and the horizontal top member has a chase and a cell edge with a flange positioned along the chase edge thereof. At least one horizontal cross-channel member is affixed at one end to said first vertical side member and at its other end to the second vertical side member. The cross-channel member has a chase edge and a cell edge and the cell edge has a cell flange positioned on the plane formed by the cell edges of the horizontal base member, the first and second vertical side members and the horizontal top member. The vertical position of the cross-channel is located at the intersection of the fixtures to be mounted on the jig. The cross member not only strengthens the jig but also provides a barrier preventing the use of the crack between adjacent fixtures as a hiding place for contraband and the like. Preferably the device has two such cross-channel members so that three fixtures can be mounted on the jig.

DESCRIPTION OF THE PREFERRED EMBODIMENTS

Figure 1:
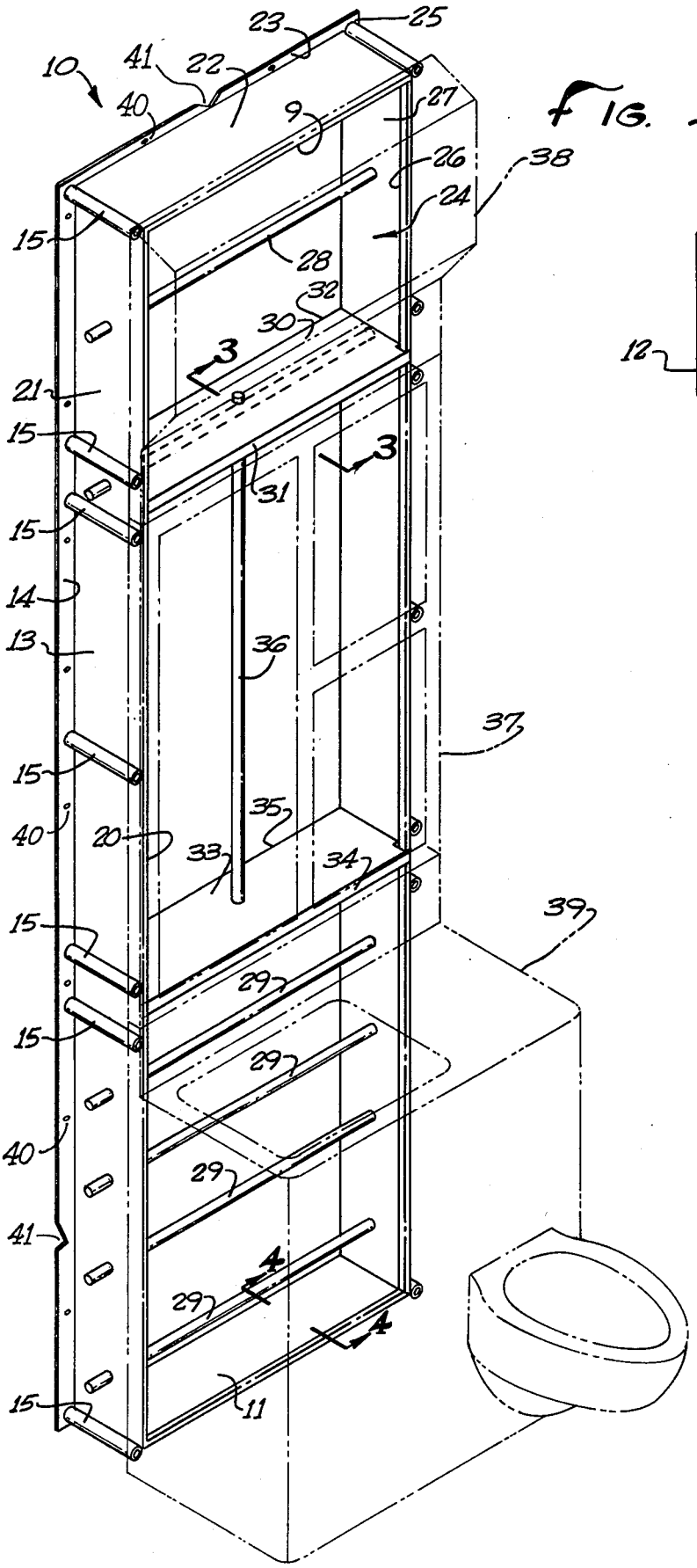
FIG. 1 is an exploded perspective view of the wall sleeve and installation jig of the present invention with the fixtures show in phantom lines.

The wall sleeve and installation jig of the present invention is shown in perspective view in FIG. 1 and indicated generally by reference character 10. The sleeve is adapted for easy mounting in a poured concrete wall and a typical installation will be in the wall between a cell and pipe chase. The pipe chase is accessible to prison guards and to service personnel so that the fixtures mounted on jig 10 may be serviced from the pipe chase without the necessity of entering the cell.

The steps required to provide maintenance service in a prison cell are labor intensive. First, it must be understood that prison guards or security personnel are not permitted to do service or maintenance work. Furthermore, maintenance personnel are not trained or equipped to guard prisoners. Still further, tools which are required to perform maintenance are potentially capable of being used as weapons and it thus becomes necessary for the maintenance personnel to be kept separated from the prisoners. Therefore, even for a simple maintenance task, it is necessary to first remove the prisoner or prisoners from the cell. Secondly, the maintenance man, accompanied by a security man enter the cell. A second security man may also be required to escort the maintenance man to the cell door. It can thus be seen that a task as ostensibly simple as changing a light bulb becomes a disruptive and labor intensive task if it must be done from within the cell.

Figure 4:
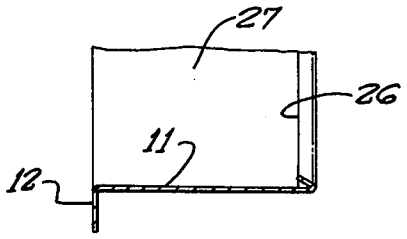
FIG. 4 is a cross-sectional view taken along line 4—4 of FIG. 1.
Figure 2:
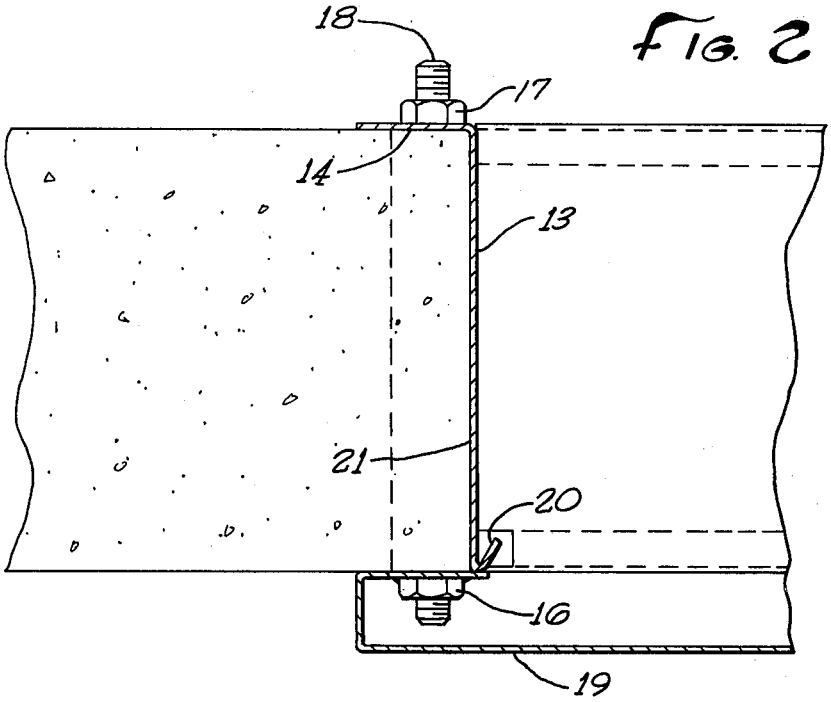
FIG. 2 is an enlarged top cross-sectional view showing one of the vertical sides of the fixture of FIG. 1.

Wall sleeve and installation jig 10 has a horizontal base member 11 which is shown in cross-sectional view in FIG. 4. Base member 11 has a flange 12 which faces the chase area. Flange 12 would typically lie along the plane of the chase wall. At one side of base member 11 a first vertical side member 13 is welded or otherwise affixed. Vertical member 13 has a flange 14 which lies along the entire chase edge of member 13. A plurality of tubes or sleeves 15 are tack-welded to flange 14 and provide a passageway for bolts or studs which are used to hold the fixture to the wall. Matching holes are punched in flange 14 at the location of tubes 15 and typically the stud is threaded into a nut welded to the fixture such as nut 16 shown in FIG. 2 which is a top view of vertical member 13 after it has been installed in a poured concrete wall. Nut 17 is also threaded on stud 18 providing a very secure means of affixing fixture 19 to jig 10. A second flange 20 is formed along the cell edge of member 13 to strengthen the member. Flange 20 is inwardly directed and has a curved edge starting at the web 21 between flange 14 and flange 20 and positioned at an angle of between about 20 and 70 degrees and preferably about 45 degrees.

A horizontal top member 22 is welded at one end to vertical member 13 and at the other end to vertical member 24. Top member 22 has a flange 23 which is located along the chase edge of member 22 and a strengthening flange 9 which is similar to flange 20 located along the cell edge thereof. Second vertical member 24 also has a flange 25 along the chase edge, a reinforcing flange 26 also inwardly directed in the manner described for flange 20 and a web 27 between the two flanges. A plurality of tubes analogous to tubes 15 are also tack-welded to flange 25 but are not shown in the drawings. An upper reinforcing bar 28 is welded to webs 21 and 27. These bars extend into the concrete in the manner shown in FIG. 2 and help lock the jig to the wall. Similarly, four reinforcing bars 29 are welded to webs 21 and 27 and extend into the concrete poured when the jig is installed in a poured concrete wall. A plurality of nail holes 40 are used to nail the jig to the wall form to locate and hold the jig in place when the concrete is poured for the wall.

Figure 3:
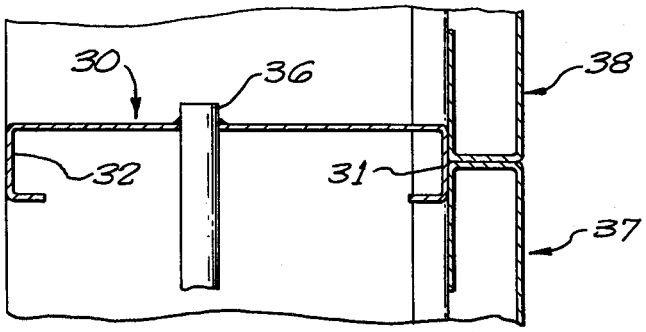
FIG. 3 is an enlarged cross-sectional view taken along line 3—3 of FIG. 1.

An upper cross-member 30 is shown in FIGS. 1 and 3. Member 30 has a "C" shape cross-section and has a flange 31 along the cell edge of member 30 and a second flange 32 along the chase edge thereof. Similarly, lower cross-member 33 has a flange 34 along the cell edge and a flange 35 along its chase edge. A reinforcing bar 36 is welded on a cross-members 30 and 33 and assists in both positioning and strengthening the jig. The sleeve becomes part of the wall and the fixture when bolted to the installed sleeve becomes securely bolted to the wall. One or more fiducial marks 41 show the center line of the jig and provide locating points to assist in positioning the fixtures on the jig.

The fixtures which can be mounted to the jig are indicated in phantom lines in FIG. 1. A lavatory fixture is indicated generally by reference character 39, a mirror fixture by reference character 37 and a light fixture by reference character 38. Each of these fixtures has nuts which are welded to an interior flange in the manner indicated in FIG. 2 and studs such as stud 18 are threaded into these nuts and they are then screwed on the chase side of the various flanges which are positioned along the chase wall. As shown in FIG. 3, cross-member 30 is positioned so that its cell flange 31 covers the intersection between fixtures 37 and 38. In this way, there is no way for anyone to hide contraband or to otherwise pass an object out of the cell. Similarly, lower cross-member 33 is positioned at the intersection between mirror fixture 37 and lavatory fixture 36.

The result is an installation jig which permits the mounting of multiple fixtures with the installation of a single sleeve in the wall. The fixtures are not only securely held to the sleeve and thus to the wall but also are held together in such a manner that the intersection between adjacent fixtures does not provide a place for hiding objects or for passing objects into and out of the cell. The jig should be fabricated from a material such as 18-gauge galvanized sheet steel. One-half inch reinforcing bars have been found to provide sufficient strength to support and strengthen the sleeve.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A wall sleeve and installation jig having multiple adjacent fixtures mounted thereon comprising:

a horizontal base member having a chase edge and a cell edge and a web therebetween, said base member having a flange positioned along its chase edge;

a first vertical side member affixed at its bottom to one end of said base member, said first side member having a chase edge and a cell edge and a web therebetween, said first vertical member having a flange positioned along its chase edge;

a second vertical side member affixed at its bottom to the other end of said base member, said second side member having a chase edge and a cell edge and a web therebetween, said second vertical member having a flange positioned along its chase edge;

a horizontal top member affixed at one end to the first vertical side member and at the other end to the second vertical side member, said top member having a chase edge and a cell edge and a web therebetween, said top member having a flange positioned along its chase edge;

a least one horizontal cross channel member affixed at one end to said first vertical side member and at its other end to said second vertical side member, said cross channel member having a chase edge and a cell edge, said cell edge of said cross channel member having a cell flange positioned on the plane formed by the cell edges of said horizontal base member, said first and second vertical side members and said horizontal top member, the vertical position of said cross channel being such that the cell flange is located at the intersection of the fixtures mounted on the jig;

a bottom rectangular fixture mounted on said jig, the upper edge of said bottom fixture lying along the cell flange of a cross channel, the lower edge of said bottom fixture lying below the surface of said horizontal base member; and a top rectangular fixture mounted on said jig, the lower edge thereof being adjacent the cell flange of a cross channel, the upper edge of said top fixture lying above the surface of said horizontal top member.

2. The wall sleeve and installation jig of claim 1 further including at least one intermediate rectangular fixture mounted on said jig, the upper edge being adjacent another rectangular fixture and the lower edge thereof being adjacent another fixture, each intersection between fixtures having a cross channel mounted so that its cell flange covers the intersection between adjacent fixtures.

3. The wall sleeve and installation jig of claim 2 wherein there is one intermediate rectangular fixture and two cross channel members.

4. The wall sleeve and installation jig of claim 1 wherein said cross channel member has a "C"-shaped cross section.

5. The wall sleeve and installation jig of claim 3 wherein a reinforcing vertical member is affixed between the two cross channel members.

6. The wall sleeve and installation jig of claim 1 further including at least one horizontal reinforcing bar affixed near each end to the first and second vertical side members.

7. The wall sleeve and installation jig of claim 1 wherein the flange positioned along the chase edge of said first and second vertical side members is oriented at a right angle with respect to the web thereof.

8. The wall sleeve and installation jig of claim 1 wherein the cell edge of the first and second vertical side members has a curved edge and an inwardly directed flange positioned at an angle between 20 and 70 degrees with respect to the web of the first and second vertical side members.

9. A wall sleeve and installation jig for multiple adjacent fixture mounting comprising:

a horizontal base member having a chase edge and a cell edge and a web therebetween, said base member having a flange positioned along its chase edge;

a first vertical side member affixed at its bottom to one end of said base member, said first side member having a chase edge and a cell edge and a web therebetween, said first vertical member having a flange positioned along its chase edge;

a second vertical side member affixed at its bottom to the other end of said base member, said second side member having a chase edge and a cell edge and a web therebetween, said second vertical member having a flange positioned along its chase edge;

a horizontal top member affixed to one end to the first vertical side member and at the other end to the second vertical side member, said top member having a chase edge and a cell edge and a web therebetween, said top member having a flange positioned along its chase edge; and at least one horizontal cross channel member affixed at one end to said first vertical side member and at its other end to said second vertical side member, said cross channel member having a chase edge and a cell edge and a web therebetween, said cell edge of said cross channel member having a cell flange positioned on the plane formed by the cell edges of said horizontal base member, said first and second vertical side members and said horizontal top member, the vertical position of said cross channel being such that the cell flange is located at the intersection of the fixtures to be mounted on the jig.

10. The jig of claim 1 further including a plurality of stud receiving tubes affixed to the flange positioned along the chase edge of each vertical side member.

11. The jig of claim 1 further including a plurality of nail holes formed in the flange positioned along the chase edge in the horizontal base member, the first and second vertical side members and the top member.

12. The jig of claim 1 further including at least one fiducial mark formed in a flange of one of said base, side or top members.

* * * * *